United States Patent [19]

Hirai

[11] Patent Number: 4,475,056

[45] Date of Patent: Oct. 2, 1984

[54] COLOR PICTURE TUBE FOR CHARACTER DISPLAY

[75] Inventor: Ryoji Hirai, Mobara, Japan

[73] Assignee: Hitachi, Ltd., Tokyo, Japan

[21] Appl. No.: 286,072

[22] Filed: Jul. 23, 1981

[30] Foreign Application Priority Data

Jul. 23, 1980 [JP] Japan ..... 55-99967

[51] Int. Cl.[3] ..... H01J 29/07

[52] U.S. Cl. ..... 313/403; 313/402

[58] Field of Search ..... 313/402, 403

[56] References Cited

U.S. PATENT DOCUMENTS 3,654,505 4/1972 Davis et al. ..... 313/402
3,686,525 8/1972 Naruse et al. ..... 313/402
3,721,853 3/1973 Naruse et al. ..... 313/402
3,777,204 12/1973 Robbins et al. ..... 313/403
3,900,757 8/1975 Kaplan ..... 313/402

FOREIGN PATENT DOCUMENTS 1163495 9/1969 United Kingdom ..... 313/402

*Primary Examiner*—Palmer C. Demeo
*Attorney, Agent, or Firm*—Antonelli, Terry & Wands

[57] ABSTRACT

A color picture tube suited for use as a video data terminal equipment of a computer system and capable of displaying characters, graphs and the like with high fineness. In a shadow mask of dot aperture type to be used in the color picture tube, a space between the adjacent dot apertures aligned on a same line in the horizontal direction and a space between the adjacent dot aperture aligned on a same line in the vertical direction is selected equal to each other.

12 Claims, 9 Drawing Figures

COLOR PICTURE TUBE FOR CHARACTER DISPLAY

The present invention relates in general to a color picture tube of a high fineness. In particular, the invention concerns a color picture tube which is capable of displaying characters, graphic patterns, charts or the like with a high fineness and suited for use in a video terminal equipment of a computer system.

The color picture tube capable of displaying characters, patterns or the like with a high fineness is widely used as a video data terminal (VDT) of a computer system. The color picture tube of 14-inch type intended to this application, for example, is usually so designed as to be able to display 25 to 40 character lines with each line being composed of eighty characters. To this end, the color picture tube includes three electron guns in an inline array and a shadow mask of a dot type having rows of dot apertures formed therein with a row space of about 0.3 mm from one another. The dot apertures of this type shadow mask are arrayed such that each dot aperture of a circular form is positioned at each of vertexes of a regular triangle for the reason that such aperture array allows trichromatic phosphor dots of a circular form to be arrayed with the highest density (i.e. with high fineness) on a phosphor screen of the tri-color picture tube in correspondence to the dot apertures of the shadow mask, whereby useless areas can be considerably excluded from the phosphor screen. When the length of a side of the regular triangle is represented by $P_1$, the sets of dot apertures each positioned at a vertex of a regular triangle are arrayed with a space equal to $P_1$ in the vertical direction, while the space between the adjacent dot aperture sets in the horizontal direction is equal to $\sqrt{3}\ P_1$. Consequently, when an image is produced on the phosphor screen by making use of the shadow mask having such dot aperture array mentioned above, there will arise a difference in brightness or luminance between the vertical and the horizontal lines as produced. In other words, a difference in brightness is produced between the vertical lines and the horizontal lines of each character displayed on the color picture tube for character display.

An object of the present invention is to provide a color picture tube of high fineness which is capable of displaying images of characters, charts or graphs with substantially uniform brightness in both vertical and horizontal directions or lines on a screen of the color picture tube.

According to the present invention, there is provided a color picture tube which comprises three electron guns of an inline array, a shadow mask of dot type and a phosphor screen having trichromatic phosphor dots deposited thereon, wherein dot apertures of the shadow mask are so arrayed that a space between the adjacent dot apertures on one and the same line or row in the horizontal direction is equal to a space between adjacent dot apertures on one and the same line or column in the vertical direction. Further, in correspondence to the array of the dot apertures formed in the shadow mask, the trichromatic phosphors are each arrayed in an elliptical or oval dot form having a long axis extending in the vertical direction. Such array of the trichromatic phosphors on the phosphor screen of the color picture tube is advantageous in that the useless or ineffectual areas of the phosphor screen can be reduced, whereby not only degradation in luminance can be effectively compensated, but also degradation in brightness can be positively prevented, even when there arises more or less vertical landing errors in electron beam landing on the phosphor screen.

These and other objects, features and advantages of the present invention will be more apparent from the following descriptions taken in conjunction with the accompanying drawings in which.

Figure 1:
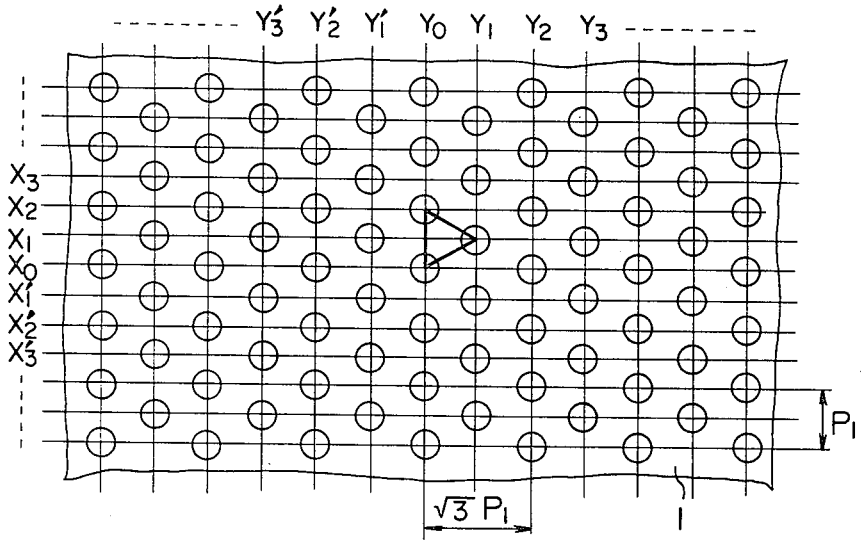
FIG. 1 PRIOR ART
FIG. 1 is a view to illustrate a dot aperture array of a shadow mask of the prior art.

Referring to FIG. 1 which shows a dot aperture array in a hitherto known dot type shadow mask, the dot apertures are positioned at respective vertexes of a regular triangle so that the closest or finest aperture array can be attained, as described hereinbefore. Horizontal lines such as denoted by $X_3$, $X_2$, $X_1$, $X_0$, $X'_1$, $X'_2$, $X'_3$ and so forth as well as vertical lines such as denoted by $Y_3$, $Y_2$, $Y_1$, $Y_0$, $Y'_1$, $Y'_2$, $Y'_3$ and so forth are, respectively, juxtaposed to one another with predetermined spaces or distances between the adjacent horizontal lines and between the adjacent vertical lines, respectively. Dot apertures are positioned at intersections between the even-numbered horizontal lines (inclusive of zero-numbered line) $X_2$, $X_0$, $X'_2$ and so forth and the even-numbered vertical lines (inclusive of zero-numbered line) $Y_2$, $Y_0$, $Y'_2$ and so forth as well as at intersections between the odd-numbered horizontal lines $X_3$, $X_1$, $X'_1$, $X'_3$ and so forth and the odd-numbered vertical lines $Y_3$, $Y_1$, $Y'_1$, $Y'_3$ and so forth, respectively. In this connection, it is assumed that the lines $X_0$ and $Y_0$ extend through the center of the shadow mask. When the length of a side of a regular triangle shown at a mid portion of the shadow mask is represented by $P_1$, the sets of three dot apertures are arrayed in the vertical direction with a space equal to $P_1$ being set between the adjacent aperture sets while in the horizontal direction, the space between the adjacent aperture sets is equal to $\sqrt{3}\ P_1$, as described hereinbefore. As the consequence, the space between the adjacent horizontal lines is equal to $P_1/2$, while the space between the adjacent vertical lines is $\sqrt{3}/2\ P_1$. It is assumed that the diameter of an electron beam satisfies the condition that $P_1 <$ beam diameter $< \sqrt{3}\ P_1$. When one horizontal line is scanned by the electron beam of such beam diameter, the electron beam may pass through a single mask aperture for every length $P_1$ of the vertical line and pass through three mask apertures for every length $\sqrt{3}\ P_1$ of the horizontal line. Consequently, brightness or luminance of the produced vertical or longitudinal lines and the produced horizontal or transversal lines become different, as can be seen from the following expression:

$$1/P_1:3/\sqrt{3}P_1=1:\sqrt{3} \quad (1)$$

In other words, the brightness or luminance of the produced horizontal or transversal lines is about $\sqrt{3}$ times as high as that of the produced vertical or longitudinal lines.

Figure 2:
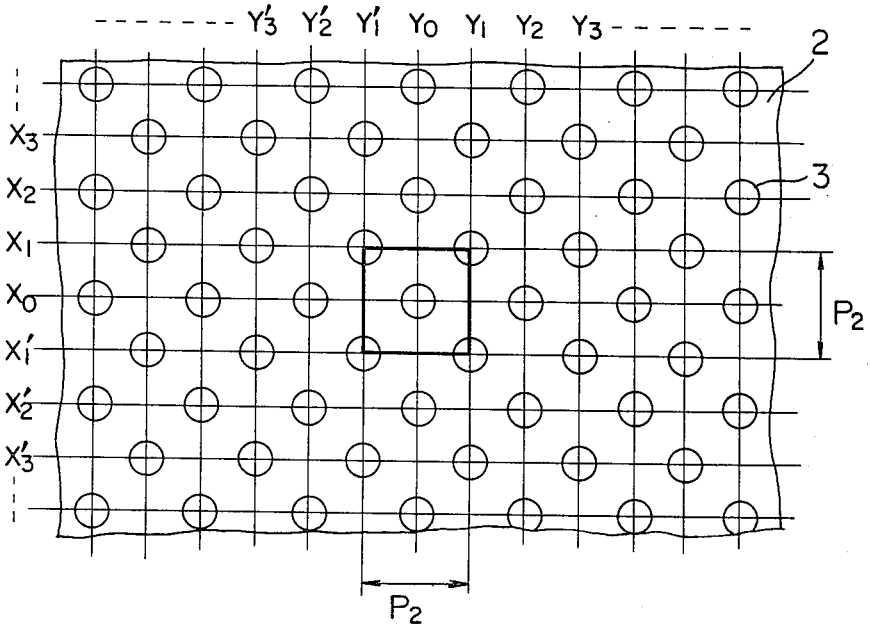
FIG. 2 is a view showing a dot aperture array in a shadow mask implemented according to an exemplary embodiment of the present invention.

FIG. 2 illustrates an array of dot apertures 3 in a shadow mask 2 according to an exemplary embodiment of the invention. It will be seen from this figure that the horizontal lines $X_3$, $X_2$, $X_1$, $X_0$, $X'_1$, $X'_2$, $X'_3$ and so forth as well as the vertical lines $Y_3$, $Y_2$, $Y_1$, $Y_0$, $Y'_1$, $Y'_2$, $Y'_3$ and so forth are, respectively, juxtaposed to one another with a same space or distance of $P_2/2$. The dot apertures 3 are positioned at the intersections between the even-numbered horizontal lines (inclusive of the zero-numbered horizontal line) $X_2$, $X_0$, $X'_2$, etc. and the even-numbered vertical lines (inclusive of zero-numbered line) $Y_2$, $Y_0$, $Y'_2$, etc. as well as at the intersections between the odd-numbered horizontal lines $X_3$, $X_1$, $X'_1$, $X'_3$, etc. and the odd-numbered vertical lines $Y_3$, $Y_1$, $Y'_1$, $Y'_3$, etc. as in the case of the hitherto known shadow mask described hereinbefore in conjunction with FIG. 1. However, in the case of the shadow mask implemented according to the invention and shown in FIG. 2, the space between the adjacent dots located on one and the same horizontal line as well as the space between the adjacent dots on one and the same vertical line is equal to $P_2$, because the space between the adjacent horizontal lines and the space between the adjacent vertical lines are both equal to $P_2/2$, as described above. In a color picture tube in which the shadow mask 2 having the array of aperture dots 3 mentioned above, the brightness of both the column lines and the row lines is substantially uniform, to a great advantage for the display of characters and the like.

Figure 3:
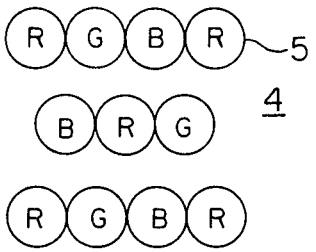
FIG. 3 is a view to show a phosphor screen according to an exemplary embodiment of the invention.
Figure 4:
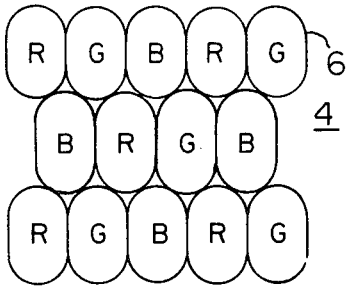
FIG. 4 is a view to show a phosphor screen according to another exemplary embodiment of the present invention.
Figure 5:
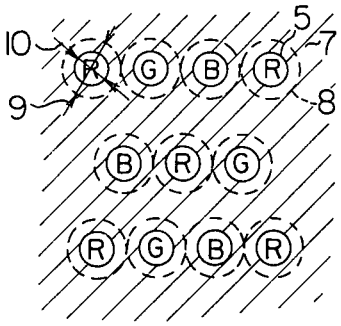
FIG. 5 is a view to illustrate relationship between electron beams and phosphor dots of the phosphor screen implemented according to an embodiment of the invention.
Figure 6:
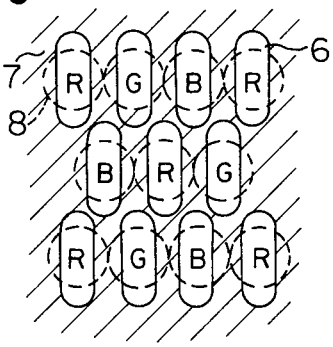
FIG. 6 is a view to illustrate relations between electron beams and phosphor dots of the phosphor screen implemented according to a further embodiment of the invention.

It should here be mentioned that the array of the tri-color phosphor dots of a circular shape on the phosphor screen in accordance with the invention will give rise to a gap between the adjacent dots 5 in the vertical direction, although the dots are positioned close to one another in the horizontal direction, as is shown in FIG. 3, where symbols R, G and B in circle represent red, green and blue phosphor dots. FIG. 4 shows an array of phosphor dots 6 each of which is of a circular form elongated in the vertical direction (i.e. elliptical form having a long axis extending in the vertical direction). With such dot array, it is obvious that influence of the landing error of the electron beam is rendered substantially inappreciable. In this connection, it is to be noted that the advantage of the phosphor dot array in which the individual elliptical dots are arrayed with the longitudinal axes thereof being aligned in the vertical direction becomes most significant in the case of a black matrix type picture tube (hereinafter simply referred to as BM tube in abridgement) which is widely employed at present not only for general use but also as the character display picture tube of the video data terminal by virtue of the feature that an improved contrast can be obtained. FIG. 5 shows an array of circular phosphor dots deposited on a phosphor screen on the assumption that the shadow mask according to the invention is used in the BM tube, although the phosphor dots of an elongated circular (i.e. elliptical) shape are employed in practical application. In this figure, reference numeral 7 denotes graphite deposition, 8 denotes an electron beam in cross-section, 9 denotes diameter of the electron beam and 10 denotes diameter of the phosphor dot. As is well known in the art, in the case of the BM type tube, the diameter 9 of the electron beam is selected greater than the diameter 10 of the phosphor dot, and the regions which are not occupied by the phosphor dots are applied or deposited with graphite (as represented by the hatched area). Although the phosphor dots 5 are arrayed relatively close to one another in the horizontal direction, there make appearance relatively large gaps among the phosphor dots 5 in the vertical direction, the gaps being filled with graphite 7. In contrast, FIG. 6 shows a phosphor screen 4 to be used in combination with the shadow mask according to the invention in a BM type tube, in which the tri-color phosphor dots 6 each of an elliptical shape are arrayed with the longitudinal axes thereof extending in the vertical direction. It will be seen that the length of the long axis of the elliptical phosphor dot is greater than the diameter 9 of the electron beam, resulting in a correspondingly increased light emitting area. In this way, degradation in brightness can be prevented.

Figure 7:
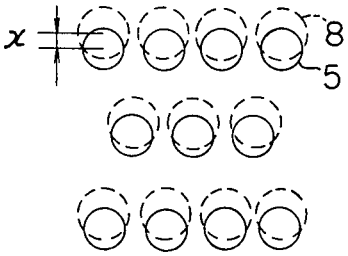
FIGS. 7 and 8 are views to illustrate landing errors of electron beams relative to phosphor dots on a phosphor screen, respectively.
Figure 8:
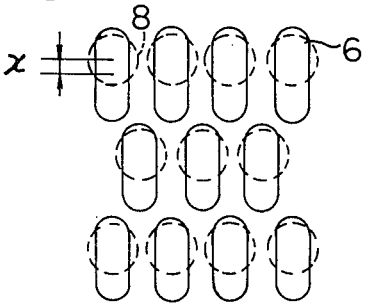
Figure 9:
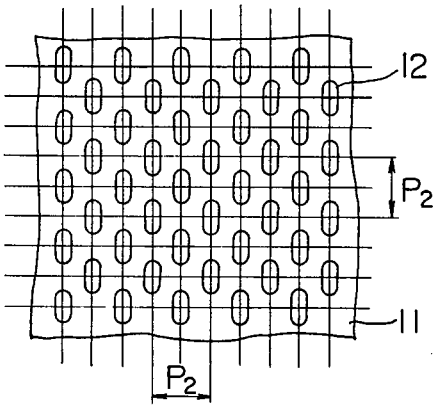
FIG. 9 is a view to show a shadow mask according to still another embodiment of the invention.

In a preferred embodiment of the present invention, the phosphor screen for the BM tube which is composed of the elliptical phosphor dot array described above may be advantageously used in combination with the shadow mask having the dot aperture array provided according to the invention as described hereinbefore. In this conjunction, it can be seen from FIGS. 7 and 8 that the beam landing error x in the vertical direction does not bring about reduction in the brightness in the case of the BM type picture tube according to the invention in which the phosphor dot array composed of the elliptical dots elongated in the vertical direction is used in combination with the shadow mask in which the spaces between the adjacent dot apertures in both the horizontal and the vertical directions are selected to be equal. FIG. 9 shows a shadow mask 11 according to another exemplary embodiment of the invention in which each of mask apertures 12 is of an elliptical form. This shadow mask 11 is effective in preventing the brightness of the phosphor screen from being lowered, because the mask aperture 12 of the elliptical shape allows a much greater part of the electron beam to pass therethrough as compared with the mask aperture of the circular shape. Of course, the shape of the mask aperture is not restricted to the ellipse, but the mask aperture of elongated shapes such as slit-like shape may equally be adopted. Further, it goes without saying that the shadow mask having the mask aperture of elongated shape may be used in combination with the phosphor screen composed of the phosphor dot array of circular or elliptical dots.

What is claimed is:

1. A color picture tube for character display, comprising three electron guns of an inline array, a shadow mask of aperture type and a phosphor screen having trichromatic phosphor elements thereon, wherein substantially all apertures of said shadow mask are arrayed such that a space between adjacent apertures on a same line in the horizontal direction is equal to a space between adjacent apertures on a same line in the vertical direction, said apertures in adjacent lines in the horizontal or vertical directions are offset with respect to one another, said apertures are one of circular shape, elongated shape and slit-like shape, and said apertures of said elongated shape and said slit-like shape have a major axis, said major axis of substantially all of said apertures extending in the same direction.

2. A color picture tube for character display according to claim 1, wherein each of the phosphor elements on said phosphor screen is in a form of one of a circle and an ellipse having a long axis extending in the vertical direction.

3. A color picture tube for character display according to claim 2, wherein said phosphor screen is of a black matrix configuration.

4. A color picture tube for character display according to claim 1, wherein substantially all of said apertures having a major axis have said major axis extending in the vertical direction.

5. A color picture tube for character display, comprising three electron guns of an inline array, a shadow mask of aperture type and a phosphor screen having trichromatic phosphor elements deposited thereon, wherein substantially all apertures of said shadow mask are arrayed such that centers of adjacent apertures on lines in the horizontal direction have a uniform spacing therebetween equal to a uniform spacing between centers of adjacent apertures on lines in the vertical direction, said apertures in adjacent lines in the horizontal or vertical directions are offset with respect to one another, said apertures are one of circular shape, elongated shape and slit-like shape, and said apertures of said elongated shape and said slit-like shape have a major axis, said major axis of substantially all of said apertures extending in the same direction.

6. A color picture tube for character display according to claim 5, wherein each of the phosphor elements on said phosphor screen is in a form of one of a circle and an ellipse having a long axis extending in the vertical direction.

7. A color picture tube for character display according to claim 6, wherein said phosphor screen is of a black matrix configuration.

8. A color picture tube for character display according to claim 5, wherein substantially all of said apertures having a major axis have said major axis extending in the vertical direction.

9. A color picture tube for character display, comprising three electron gun means of an inline array, shadow mask means of aperture type, phosphor screen means having trichromatic phosphor elements deposited thereon, and means for enabling character display on the phosphor screen means with substantially uniform brightness on lines in both the horizontal and vertical directions of the phosphor screen means, the substantially uniform brightness means including arraying substantially all of the apertures of the shadow mask means along lines in the horizontal and vertical directions so as to provide a uniform spacing between centers of adjacent apertures on lines in both the horizontal and vertical directions, the uniform spacing in the horizontal and vertical directions being equal to each other, the apertures in adjacent lines in the horizontal or vertical directions being offset with respect to one another, the apertures being one of circular shape, elongated shape and slit-like shape, and the apertures of the elongated shape and the slit-like shape have a major axis, the major axis of substantially all of the apertures extending in the same direction.

10. A color picture tube for character display according to claim 9, wherein each of the phosphor dots on the phosphor screen means is in a form of an ellipse having a long axis extending in the vertical direction.

11. A color picture tube for character display according to claim 10, wherein the phosphor screen means is of a black matrix configuration.

12. A color picture tube for character display according to claim 9, wherein substantially all of the apertures having a major axis having the major axis extending in the vertical direction.

* * * * *